United States Patent [19]

Horsma

[11] 4,314,145

[45] * Feb. 2, 1982

[54] ELECTRICAL DEVICES CONTAINING PTC ELEMENTS

[75] Inventor: David A. Horsma, Palo Alto, Calif.

[73] Assignee: Raychem Corporation, Menlo Park, Calif.

[ * ] Notice: The portion of the term of this patent subsequent to Jan. 20, 1998, has been disclaimed.

[21] Appl. No.: 8,617

[22] Filed: Feb. 1, 1979

Related U.S. Application Data

[63] Continuation-in-part of Ser. No. 873,676, Jan. 30, 1978, Pat. No. 4,246,468.

[51] Int. Cl.[3] ..... H05B 3/10

[52] U.S. Cl. ..... 219/553; 174/110 PM; 219/505; 219/510; 219/528; 219/544; 219/548; 264/105; 252/511; 338/20; 338/22 R; 338/214

[58] Field of Search ..... 219/504, 505, 510, 528, 219/543, 544, 548, 552, 553; 174/DIG. 8, 91, 92, 93; 264/25, 105; 252/502, 510, 511, 512; 338/20, 22 R, 22 SD, 211, 212, 333; 204/159.17

[56] References Cited

U.S. PATENT DOCUMENTS

| | | | |
|---|---|---|---|
| 3,351,882 | 11/1967 | Kohler et al. | 338/322 |
| 4,017,715 | 4/1977 | Whitney et al. | 219/553 |
| 4,085,286 | 4/1978 | Horsma et al. | 174/92 |
| 4,177,376 | 12/1979 | Horsma et al. | 219/553 |
| 4,188,276 | 2/1980 | Lyons et al. | 252/511 X |
| 4,246,468 | 1/1981 | Horsma | 219/553 |

FOREIGN PATENT DOCUMENTS

| | | | |
|---|---|---|---|
| 2543314 | 9/1975 | Fed. Rep. of Germany | 219/552 |

*Primary Examiner*—Volodymyr Y. Mayewsky
*Attorney, Agent, or Firm*—Lyon & Lyon

[57] ABSTRACT

The invention relates to novel electrical devices which are useful for example as heaters and temperature sensors, and which comprise at least two electrodes, at least one PTC element, at least one relatively constant wattage element, and at least one current-directing element which directs the current, when the device is first connected to a source of electrical power, so that the effective initial resistance of the device is greater than it would be in the absence of said element. Thus the invention provides a solution to the problem of current inrush in application of PTC devices in which substantial current passes through the device at operating temperatures. The invention also includes the use of the novel devices in applications in which current inrush is not a problem.

4 Claims, 8 Drawing Figures

ELECTRICAL DEVICES CONTAINING PTC ELEMENTS

Figure 1:
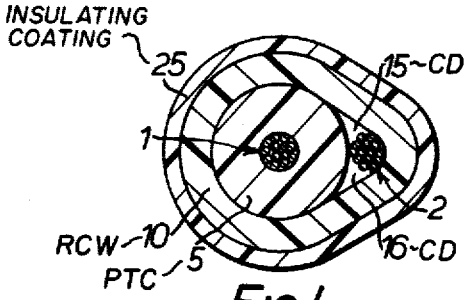

This is a continuation-in-part of my copending application for Electrical Devices Containing PTC Elements, Ser. No. 873,676 filed Jan. 30, 1978, now U.S. Pat. No. 4,246,468

This invention relates to electrical devices which comprise at least two electrodes and at least one PTC element, and methods of employing, especially for heating and temperature sensing, such devices.

The resistivity of many electrically conductive materials changes with temperature. The terminology which has been used in the past to describe the different kinds of resistance/temperature variation is variable and often imprecise but, broadly speaking, materials which increase in resistivity are designated PTC (positive temperature coefficient) materials; those that decrease in resistivity are designated NTC (negative temperature coefficient) materials; and those which show no substantial change in resistivity are designated CW (constant wattage) or ZTC (zero temperature coefficient) materials. However, some materials show quite different temperature ranges; for example a material may show CW behaviour at low temperature and PTC behaviour at higher temperatures and/or may show, in a specific temperature range, a very much greater rate, or change in the rate, at which resistivity changes with temperature than outside that range.

In this specification, the terms "composition exhibiting PTC behaviour" and "PTC composition" are used to denote a composition having at least one temperature range (hereinafter called a "critical range") which is within the limits of −100° C. and about 350° C., at the beginning of which the composition has a resistivity below $10^5$ ohm.cm.; and in which the composition has an $R_{14}$ value of at least 2.5 or an $R_{100}$ value of at least 10 (and preferably both), and preferably has an $R_{30}$ value of at least 6, where $R_{14}$ is the ratio of the resistivities at the end and the beginning of a 14° C. range, $R_{100}$ is the ratio of the resistivities at the end and the beginning of a 100° C. range, and $R_{30}$ is the ratio of the resistivities at the end and the beginning of a 30° C. range. The term "PTC element" is used herein to denote an element comprising a PTC composition as defined above. A plot of the log of the resistance of a PTC element, measured between two electrodes in contact with the element, against temperature, will often, though by no means invariably, show a sharp change in slope over a part of the critical temperature range and, in such cases, the term "switching temperature" (usually abbreviated to $T_s$) is used herein to denote the temperature at the intersection point of extensions of the substantially straight portions of such a plot which lie each side of the portion showing the sharp change in slope. The PTC composition in such a PTC element is described herein as having "a useful $T_s$". The term "anomaly temperature" has also been used in the past to denote the temperature at which a PTC element shows a sharp increase in the rate at which resistance increases with temperature.

PTC compositions and electrical devices, especially heaters, which contain PTC elements, have been described in a number of publications. Reference may be made for example to U.S. Pat. Nos. 2,978,665; 3,243,753; 3,351,882; 3,412,358; 3,413,442; 3,591,526; 3,673,121; 3,793,716; 3,823,217, 3,858,144; 3,861,029; 3,914,363; and 4,017,715; British Pat. No. 1,409,695; Brit. J. Appl. Phys. Series 2, 92 569-576 (1969, Carley Read and Stow); Kautschuk and Gummi II WT, 138-148 (1958, de Meij); Polymer Engineering and Science, November 1973, 13, No. 6, 462-468 (J. Meyer); U.S. Patent Office Defensive Publication No. T 905,001; German Offenlegungschriften Nos. 2,543,314.1, 2,543,338.9, 2,543,346.9, 2,634,931.5, 2,634,932.6, 2,634,999.5, 2,635,000.5, and 2,655,543.1; and German Gebrauchmuster 7, 527,288. Reference may also be made to U.S. patent application Ser. No. 601,424, now abandoned (and the continuation thereof Ser. No. 790,977, now abandoned); 601,549, now abandoned (and the CIP thereof Ser. No. 735,958, now abandoned); 601,550, now U.S. Pat. No. 4,188,276; 601,638, now Pat. No. 4,177,376; 601,639, now abandoned; 608,660, now abandoned; 638,440, now abandoned (and the CIP thereof Ser. No. 775,882, now U.S. Pat. No. 4,177,446); 732,792, now abandoned; 750,149, now abandoned; 751,095, now abandoned; and 798,154, now abandoned. The disclosure of each of these publications and applications is hereby incorporated by reference.

As discussed in U.S. application Ser. No. 601,638 and the corresponding German Offenlegungschrift No. 2,543,314.1, current inrush is an important problem which can arise in the use of electrical devices containing PTC elements, especially heaters. Such devices are usually used in a way such that the PTC element is initially at room temperature when current first passes through it, but subsequently operates at an elevated working temperature (hereinafter referred to as the "operating temperature") at which its resistance is substantially higher than at room temperature. As a result, when current is passed through the PTC element, the size of the initial current in the circuit containing the PTC element can be very much greater than it is at a later stage when the device is at its operating temperature. If, as in the case of heaters, a substantial current is required for effective operation at the operating temperature, the size and duration of the initial current can be such that the device itself or other components of the circuit can be permanently damaged, unless precautions are taken to prevent this initial current inrush. Another important problem which can arise in the use of electrical devices containing PTC elements, especially heaters, is the formation of "hot-lines" in the PTC element. As discussed in U.S. Ser. No. 601,638 and the corresponding German Offenlegungschrift No. 2,543,314.1, and also in U.S. Ser. No. 608,660 and the corresponding German Gebrauchsmuster No. 7,527,288, if the preferred current path through a relatively thin PTC element is transverse to the thickness of the element then, as the temperature of the element increases, there is a tendency for a part of the element, extending across the thickness of the element, to be heated much more rapidly than the remainder, thus giving rise to a so-called "hot-line". The presence of a hot-line seriously reduces the heat output of a PTC element, because relatively little heat is generated outside the hot-line; in addition the presence of a hot-line renders the heat output non-uniform and can damage the PTC element.

U.S. Ser. No. 601,638 and the corresponding German Offenlegungschrift No. 2,543,314.1 describe inter alia electrical devices which comprise at least two electrodes, at least one first electrically resistive layer and at least one second electrically resistive layer; at least a part of the surface of the first layer being contiguous with at least a part of the surface of the second layer; the first layer exhibiting a positive temperature coefficient of resistance and having an anomaly temperature; the second layer having a substantially constant resistance (as defined in said application and Offenlegungschrift) below the anomaly temperature of the first layer; and the electrodes and the resistive layers being such that, at the higher of (a) the anomaly temperature of the first layer, and (b) the temperature at which the resistance of the first layer exceeds the resistance of the second layer, current flowing between the electrodes predominantly follows the directionally shortest path through the first layer. As described in detail in said application and Offenlegungschrift, in such devices the formation of "hot-lines" is substantially avoided. In addition, the said application and Offenlegungschrift describe how the problem of current inrush can be mitigated by appropriate choice of the positioning of the electrodes and the relative resistivities of the resistive layers in such devices, the problem of current inrush can be substantially reduced. While the invention described in said application and Offenlegungschrift is extremely valuable, the restrictions on the choices mean that it does not provide a solution to the problem of current inrush which is satisfactory in all cases.

The present invention provides a novel electrical device which comprise at least two electrodes and at least one PTC element and which, when used in applications in which current inrush can cause problems, can be operated (or inherently operate) in a way which substantially mitigates those problems. It is to be noted that the problems associated with current inrush arise in applications in which the utility of the device depends not only on the way in which the current passing through the device varies with temperature but also on the current having a sufficiently high absolute value at operating temperatures to produce a desired result, for example, in the case of a heating device, an adequate generation of heat. The novel devices of the invention can of course be used in such applications, but they can also be used in other applications in which a lower current passes through the device at its operating temperatures and in which the utility of the device depends primarily upon the way in which the current passing through the device varies with temperature, for example when the device is used for temperature sensing. The invention, therefore, includes the use of the novel devices in such other applications as well as in the applications in which current inrush causes problems. It is also to be noted that although some of the novel devices, when used in applications in which current inrush can cause problems, inherently operate in a way which reduces those problems, others of the novel devices must be operated in particular ways if they are to reduce those problems. The invention includes the use of such other devices in such applications even when they are not operated in those particular ways, other means then preferably being used to overcome the current inrush problems.

In one aspect, the present invention is based on the discovery that in an electrical device which comprises at least two electrodes which are connectable to a source of electrical power, at least one PTC element and at least one relatively CW element (as hereinafter defined), the problems associated with current inrush can be substantially reduced by including in the device at least one current-directing element such that, when the electrodes are connected to a source of electrical power while the device is at a temperature (generally room temperature) below its operating temperature or substantially immediately (as hereinafter defined) after such connexion, the current path between the electrodes passes through at least one PTC element and at least one relatively CW element, with the resistance of that current path being greater than the resistance of the current path which would be adopted if the current-directing element was replaced by an element of the same shape (a term used herein to include dimensions) but composed of the same composition as that relatively CW element. The term "CD element" is used herein to denote such a current-directing element. The presence of the CD element(s) increases the initial resistance (or the effective initial resistance as explained hereinafter) of the device, but preferably has comparatively little or no effect on the resistance of the device at elevated operating temperatures, and thus reduces the ratio of the effective initial current to the current at elevated operating temperatures. The initial resistance (or the effective initial resistance) of the device is preferably more than 50%, especially more than 80%, of the resistance of the device when it is being used at elevated operating temperatures to supply substantial thermal output, especially when it is being operated at a temperature around the effective $T_s$ of a PTC element therein.

The terms "relatively CW element" and "RCW element" are used in this specification to denote an element whose resistance is less than the resistance of the PTC element or elements over at least a part of the temperature range in which the device can be operated, or, if there is more than one RCW element, each element of a combination of elements whose combined resistance is less than the combined resistance of the PTC element or elements over at least a part of the temperature range in which the device can be operated.

As will be further elucidated below, current can flow between the electrodes of a device constructed according to the invention along a plurality of different paths, but will predominantly flow along the path or paths of least electrical resistance. It is, therefore, to be understood that references in this specification to the current path (and similar terms) mean the preferred current path of least electrical resistance (i.e., that carrying the greatest current 'flux'). The resistivity of any segment of the PTC element or elements (and in many cases, the resistivity of any segment of the RCW element or elements and, in some cases, the resistivity of any segment of the CD element or at least one of the CD elements) is dependent on the temperature of that segment. In consequence, the preferred current path between the electrodes, the total resistance between the electrodes and the individual contributions to that total resistance from the PTC element or elements and the RCW element or elements, will generally all be influenced by the absolute and relative values of the temperature in the different parts of the device; furthermore, all of them will generally be changing from the time that the electrodes are first connected to a source of electrical power to the time an equilibrium temperature has been reached.

In the devices according to the invention, the CD element may be composed of a relatively insulating composition, i.e., a composition which has a resistivity sufficiently high to ensure that, if the (or each) CD element is composed of such a composition then, as soon as the electrodes are connected to a source of electrical power, the CD element will cause the current to take a path which passes through at least one PTC element and at least one RCW element and whose resistance is greater than the resistance of the current path which would be adopted if the CD element was replaced by an element of the same shape but composed of the same composition as the RCW element. Such a composition is referred to herein as an "RI composition".

Alternatively the CD element can be composed of a composition which can be converted into a relatively insulating composition by passing electric current therethrough. Such a composition is referred to herein as a "potentially relatively insulating composition" or a "PRI composition". In this case it is essential that the initial current path between the electrodes should pass through the CD element and substantially immediately create therein a relatively insulating zone (which may be part or all of the element), such that the subsequent current path between the electrodes passes through at least one PTC element and at least one RCW element, with the resistance of that current path being greater than the resistance of the current path which would be adopted if the RI zone was replaced by a zone of the same shape but of the same composition as that RCW element.

The term "substantially immediately" is used herein to mean that the defined current path is established sufficiently rapidly that the duration of the initial current surge is insufficient to damage any of the components of the circuit, for example generally less than 5 seconds, preferably less than 2 seconds, especially less than 1 second. For example, when the CD element is composed of a PRI composition, providing the RI zone is created sufficiently rapidly, the effective initial resistance of the device will be its resistance after the RI zone has been created, and although there may be a very high initial current while the RI zone is being created, that high initial current will be so transient that it will not have an adverse effect. It should be noted that the term "subsequent current path" is used herein merely to mean the current path for an appreciable period after the RI zone has been created, since there are embodiments of the invention in which the CD element, at some later stage after the electrodes have been connected to a source of electrical power, ceases to direct current in the way initially required.

Particularly important PRI compositions are PTC compositions. When the CD element is composed of a PTC composition, it can be an integral part of the PTC element, the device being so constructed that there is a highly favoured current path through that part of the PTC element when the electrodes are first connected to a source of electrical power. Alternatively the CD element can be a separate component which is of a PTC composition which is the same as or different from the PTC composition in the PTC element. Since the speed with which an RI zone will be created in such a CD element is dependent inter alia on the thermal mass of the element and the rate at which heat is removed from it, it is generally desirable that when the CD element is a separate component it should be relatively thin and thermally insulated.

The electrical devices of the invention can contain two or more CD elements, for example one or more elements of an RI composition and another of a PRI composition; in this case, the element or elements composed of an RI composition does or do not necessarily direct the current as soon as the device is connected to a source of electrical power, but must do so as soon as the relatively insulating zone has been created in the CD element of a PRI composition.

The CD element must be of a composition which initially is, or at least part of which substantially immediately becomes, a relatively insulating composition. However, it is to be understood that at some later stage in the operation of the device, after the CD element itself and the other parts of the device have been heated by passage of current therethrough, the resistivity of the CD element may be the same as or lower than the resistivity of other parts of the device.

The PTC elements of the devices of the present invention may be of any PTC composition. However, for many uses ceramic PTC compositions, e.g. doped barium titanate, are undesirably rigid. It is, therefore, preferred to use a conductive polymer composition, i.e. a dispersion of at least one finely divided conductive filler, preferably carbon black, in a polymer or mixture of polymers, for example as described in the patents and patent applications referred to above. The PTC elements will generally have a resistivity at 10° C. of 1 to 2,500 ohm.cm, preferably 2 to 1000 ohm.cm, with resistivities at the lower end of this range, e.g. 1 to 250 ohm.cm, preferably 5 to 50 ohm.cm, being preferred for devices for use with electrical supplies of low voltage e.g. DC of 12 to 36 volts, and higher resistivities, usually at least 80 ohm.cm, e.g. 80 to 500 ohm.cm, being preferred for devices of use at higher voltages, e.g. AC of 110, 240 or 480 volts. The time taken to establish the defined current path will usually be shorter, the higher the voltage. The PTC composition preferably has a useful $T_s$ within the range of from 0° to 280° C., particularly between 35° and 160° C. It is also preferable that the PTC composition have an $R_{30}$ value of at least 6.

The RCW elements used in the present invention are preferably also conductive polymer compositions. The resistivity of the RCW element(s) at 20° C. may be greater or less than that of the PTC element(s) in the same device, generally in the range 0.1 to 1000 ohm.cm, typically 1 to 250 ohm.cm. The RCW composition may exhibit PTC behaviour but, if it does so, it should preferably not have a critical range below any critical range of the PTC element. It is often useful to employ a PTC element having a first useful $T_s$ in conjunction with an RCW element having a second useful $T_s$ which is higher, preferably at least 25° C. higher, than the first useful $T_s$.

The CD elements used in the present invention can be composed of any RI or PRI composition. Suitable RI compositions include for example air and other fluids, and compositions comprising a natural or synthetic organic polymer. Typically the RI composition will have a resistivity at room temperature which is at least 5 times, preferably at least 10 times, the resistivity at room temperature of any of the other conductive elements in the device. The resistivity can of course be much higher, e.g. at least 2,500 ohm.cm, but the invention also contemplates the use of RI compositions whose resistivity at the elevated operating temperature of the device is comparable to, or lower than, the resistivity of at least one of the other elements, so that at such operating temperature current can flow through the CD element. As noted above, particularly important PRI compositions are PTC compositions, and the device can be so constructed that there is highly favoured initial current path through a part of the PTC element, so that that part of the PTC element provides a CD element, or a part thereof. When a CD element is provided in a PTC element by placing a round electrode adjacent to the PTC element so that there is a limited area of contact between the electrode and the PTC element, the device will normally also include at least one other CD element which is composed of an RI composition, and which is adjacent to the limited contact area, since the requirement for a highly favoured initial current path will normally mean that the RI zone created in the PTC element is relatively small and will not, in itself, redirect the initial current to a sufficient extent to cause a useful reduction in current inrush. A convenient way of creating a highly favoured current path is for the PTC element to contact two electrodes of opposite polarity, with the contact area with one of the electrodes being limited, for example to less than 20% of the total surface area of the electrode, or alternatively with the PTC element having a thin section at some point between the electrodes.

When the CD element is composed of a PTC composition and is not an integral part of a PTC element, the PTC composition of the CD element generally has a useful $T_s$ which is below, preferably at least 25° C. below, the useful $T_s$ of the PTC element.

The presence of a CD element in the devices of the invention will normally (but not necessarily) cause the current to take a geometrically longer path through the RCW element. However, it is only necessary that the resistance of the current path adopted by reason of the presence of CD element(s) should be greater than it would be in the absence thereof.

The electrodes used in the present invention may have any suitable configuration and be composed of any suitable material. For most purposes, and especially when the electrode is long, compared with its other dimensions and with the electrode spacing, it is preferable to use electrodes of copper, aluminum or another metal having a suitably low resistivity. For example the electrode may be a solid or stranded wire, e.g. a tin-coated copper wire, or a solid or perforated metal tape or plate, or a woven wire mesh. However, for some devices, satisfactory electrodes can be composed of other materials, e.g. conductive polymers, having a suitably low resistivity, preferably a resistivity which between 20° C. and the operating temperature of the device, e.g. 150° C., is not more than 0.1 times the resistivity of any other element of the device. The term "electrode" is used herein to include electrodes as described above which have a coating thereon of a (or another) conductive polymer composition having a resistivity which is higher than that of the metal (or other) core.

The devices of the invention can be of any configuration which will fulfil the requirements set out above. Preferably, the elements and electrodes are so arranged that, when the device is connected to a source of electrical power and heat is being removed therefrom at substantially the same rate as it is being generated by the passage of current through the device, the formation of hotlines is substantially avoided. With this object in view, the devices preferably comprise at least one PTC element which is at least in part in the form of a layer, and preferably also at least one RCW element which is at least in part in the form of a layer, the surfaces of the layers being at least partially contiguous. Advantageously at least 50%, preferably at least 75%, of the surface of at least one of the electrodes is in contact with a PTC element, with 100% being particularly preferred, not only for electrical characteristics but also for ease of manufacture; in such devices at least part of the PTC element has a generally annular cross-section when it surrounds a round electrode, and such a cross-section is included in the term "layer" used above.

It has been found that the devices of the invention are of particular value when they are in the form of elongate devices for use as heaters or temperature-sensing devices. Especially in such elongate devices, it is preferred that each of the electrodes and elements should run the length of the device, i.e. should be present in substantially all cross-sections through the device, and for ease of manufacture and uniformity of performance it is usually desirable that the device should have substantially the same cross-section throughout its length. The devices will normally have an outer layer of insulating material.

Several forms of device constructed in accordance with the invention will now be described in greater detail, by way of example, with reference to the accompanying drawings, in which each of FIG. 1 to 8 show cross-sections through elongate devices which have substantially constant cross-section throughout their length.

Figure 3:
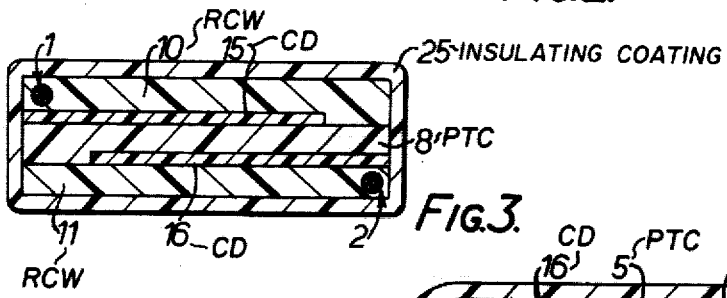
Figure 4:
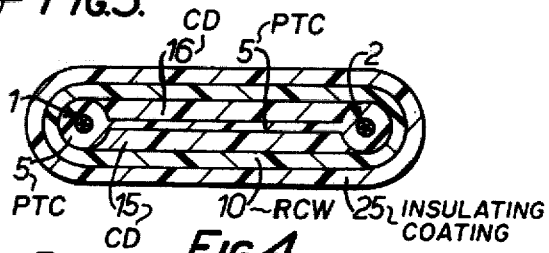
Figure 5:
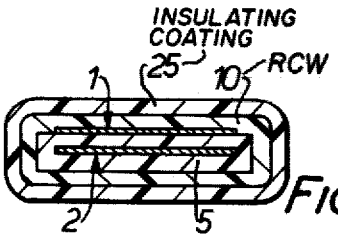
Figure 7:
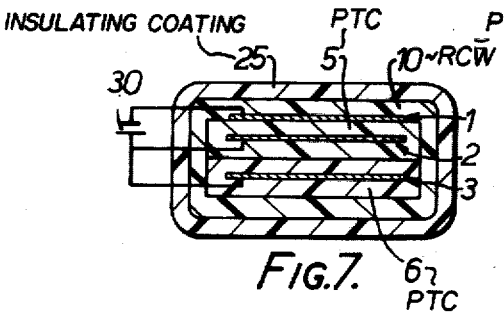

In the Figures, electrodes are denoted by numerals, 1, 2 and 3, the electrodes being round stranded wire electrodes [e.g. 26 AWG (diameter 0.01875 inch, 0.048 cm) tin-coated copper wire comprising 19 strands] in FIGS. 1 to 4 and 6, and strip electrodes [e.g. of tin-coated copper 3×250 mil (0.008×0.6 cm)] in FIGS. 5 and 7; PTC elements are denoted by numerals 5 and 6 when they and the electrodes are so arranged that a part of the PTC element provides a CD element or part of a CD element; and by numeral 8 when this is not the case; RCW elements are designated by numerals 10 and 11; separate CD elements are denoted by numerals 15 and 16; insulating coatings are denoted by numeral 25; and sources of electrical power, e.g. batteries, are denoted by numeral 30.

Referring now to FIG. 1, which shows a device which is particularly useful as a heater, an electrode 2 makes line contact with a PTC element 5, and CD elements 15 and 16 are composed of air. When the electrodes 1 and 2 are connected to a source of electrical power, the initial current flow is directly between the electrodes through PTC element 5, but the heating effect of this current substantially immediately creates an RI zone in the PTC element and shuts off this current path. The current then flows between the electrodes through RCW element 10 and PTC element 5, the predominant current path first being the geometrically shortest one available through the elements 5 and 10, and gradually becoming longer as the PTC element is selectively heated by resistance heating, until at equilibrium substantially all the PTC element through which current is passing is at a temperature approaching the $T_s$ of the element. In this equilibrium state, which may be reached, for example, in 30 to 100 times the time taken to create the RI zone in the PTC element, some of the current will now pass directly between the electrodes through PTC element 5, since the zone which was initially relatively insulating now has a resistivity which is comparable to the resistivity of other parts of the PTC element 5. It will be seen that if the RCW element 10 extended into the voids 15 and 16, which are CD elements, this would reduce the length of the initial current path through the RCW element. If the RCW element filled the voids 15 and 16, there would no longer be such a highly favoured initial current path through the PTC element so that creation of the RI zone would take substantially longer.

Using a device as shown in FIG. 1 in which the electrodes are 26 gauge wires and both the RCW and PTC layers are about 10 mil (0.25 mm) thick and have a room temperature resistivity of about 5 ohm.cm, with a 12 volt power supply, an RI zone will be created in the section of the device closest to the power supply in a very short time, e.g., of the order of 5 milliseconds, but the longer the device the longer will be the time taken to create an RI zone throughout the length of the heater. For example a time of about 5 seconds might be needed for a 10 foot (about 3 meters) length.

Figure 2:
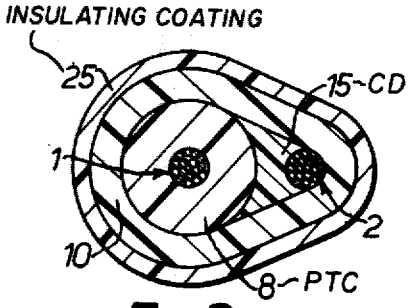

FIG. 2 illustrates a heater similar to that shown in FIG. 1, except that electrode 2 is separated from PTC element 8 by solid CD element 15 which also replaces voids 15 and 16 of FIG. 1 and which is composed of an RI or PRI composition. When CD element 15 is composed of a PTC material having a $T_s$ below the $T_s$ of PTC element, the device operates in substantially the same way as the device of FIG. 1, the CD element being heated substantially immediately to a temperature at which it directs the current through the RCW layer. The lower the $T_s$ of the CD element, and the higher its resistivity, the shorter will be the time needed to create an RI zone therein.

When the whole length of CD element 15 composed of PTC material is at a temperature such that it contains an RI zone, and the current path is through the RCW layer, the resistance of the device can be substantially higher, e.g. by a factor of 2 or more, than it is when the current can (at any point along the device) pass directly between the electrodes through PTC element 8 and CD element 15. The device is, therefore, very useful as a temperature sensor. One way of using the device in this way is to pass a low current, insufficient to cause substantial resistive heating, through the device and to monitor the current; a sharp decrease in the current indicates that the whole length of the device has reached a particular temperature. Thus the device can be distributed in serpentine fashion throughout a liquid or solid body to be heated, and used to indicate when the whole of the body has reached a particular temperature. The body can be heated externally or internally by a separate heater. Alternatively the device itself can first be used as a heater using a relatively high current, and then, after switching off the relatively high current and allowing the device to reach thermal equilibrium with the body, the device can be used as a temperature sensor as described above.

FIG. 3 shows a laminated heater having planar CW, CD and PTC elements, the CD elements being composed of PTC material. Initial current flow is diagonally across the device, but RI zones are created substantially immediately in CD elements 15 and 16, causing the current to flow in serpentine fashion, through significant portions of the width of CW elements 10 and 11 and PTC element 8.

FIG. 4 shows a heater having a PTC element 5 which joins the two electrodes but has a thin central section flanked by CD elements 15 and 16 which may be composed of an RI composition (for example a foamed RI composition to provide thermal insulation of the thin section of the PTC element) or may be composed of a PRI composition, preferably a PTC composition having a useful $T_s$ below the useful $T_s$ of the PTC element. Initial current flow is through the thin section of the PTC element, creating an RI zone therein, and the, if CD elements 15 and 16 are PRI elements, through them until RI zones are created therein. Subsequent current flow is through the parts of the PTC element which surround the electrodes and through RCW element 10.

FIG. 5 shows another laminated heater. Initial current flow is across the upper section of PTC element 5 which lies between the two planar electrodes 1 and 2, but this substantially immediately creates an RI zone in this section of the PTC element, and subsequent current flow is through RCW element 10 and the lower section of PTC element 5, and the edge portions of both elements.

Figure 6:
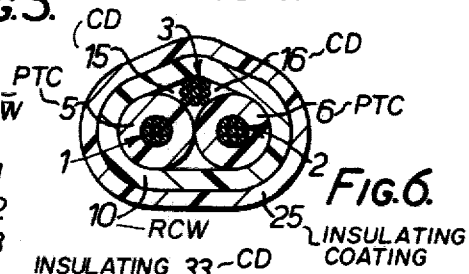

FIG. 6 shows a device which is useful as a heater and as a temperature sensor. The device has electrodes 1, 2 and 3 (which may be as described in FIG. 1), electrodes 1 and 2 being surrounded by PTC elements 5 and 6, with which electrode 3 makes line contacts. PTC elements 5 and 6 can be the same or different, but element 6 preferably has a lower useful $T_s$ than element 5. RCW element 10 surrounds and contacts electrode 3 and PTC elements 5 and 6, leaving voids 15 and 16 adjacent electrode 3 which are CD elements.

In one method of using this device, electrodes 1 and 3 are connected to a suitable source of electrical power and the device used as a heater in substantially the way described in FIG. 1, electrode 2, having essentially no active role at this stage. If the heating current is then turned off, and the device allowed to reach thermal equilibrium, electrode 2 can be used as a temperature sensor by connecting electrodes 2 and 3 to another source of electrical power, in substantially the same way as described in FIG. 2.

In another method of using this device, electrodes 1 and 2 are connected to one pole of a suitable source of electrical power, and electrode 3 is connected to the opposite pole, and the device used as a heater. When the PTC elements 5 and 6 are identical, the device operates as two heaters in parallel, each heater operating substantially as described with reference to FIG. 1. If, however, PTC element 6 has a lower useful $T_s$ than element 5, the device operates in this way for an initial period, but as the temperature increases and element 6 approaches and exceeds its $T_s$, the thermal output of the heater drops. This type of behavior is useful when a reduction in the thermal output of the heater over a particular temperature range is desired.

FIG. 7 shows a device which is useful as a heater and as a temperature sensor. Except that it is a laminar article, it is similar to the device shown in FIG. 6, and can be used in the same ways. In FIG. 7 the device is shown connected to battery 30 for use as a heater.

Figure 8:
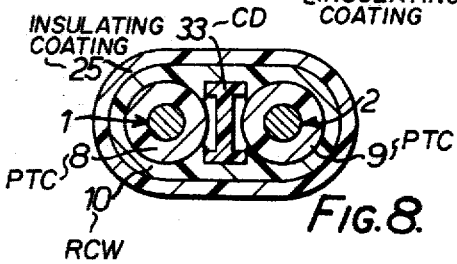

FIG. 8 illustrates a device useful as a heater. In this embodiment of the invention, conductors 1 and 2 are solid conductors, for example 20 AWG (0.032 in, 0.8 mm, diameter), which are each surrounded by an annular layer 8,9, of PTC material, e.g., a conductive polymeric composition of thickness 0.02" (about 5.0 mm). Between the two layers 8,9 is positioned a rod 33, of I-shaped cross-section, of insulating material, e.g., of overall cross-section 0.070×0.10 inches (about 1.8×2.5 mm). The assembly of PTC layers 8 and 9 and the rod 33 is surrounded by an RCW layer 10, which is in turn surrounded by an insulating layer 25, these layers 10 and 25 being, e.g., of thickness about 0.01 inches, or about 2.5 mm.

The devices illustrated in FIGS. 1, 2, 4, 5, 6, 7 and 8 are examples of a preferred class of devices according to the invention, namely those having a substantially constant cross-section and comprising (a) at least two electrodes which are connectable to a source of electrical power;

(b) at least one PTC element which is composed of a PTC composition having a useful $T_s$ of 0° to 280° C. and which surrounds and physically contacts substantially the whole of the surface of one of said electrodes;

(c) at least one relatively constant wattage (RCW) element which surrounds said electrodes and PTC elements and which makes physical contact with the or each said PTC element; and (d) at least one current-directing (CD) element;

said electrodes and said PTC, RCW and CD elements being so arranged that, when the electrodes are connected to a source of electrical power while the device is below its operating temperature or substantially immediately after such connection, the current path passes through at least one PTC element and at least one RCW element, with the resistance of that current path being greater than the resistance of the current path which would ne adopted if the CD element was replaced by an element of the same shape but composed of the same composition as that RCW element.

The devices illustrated in FIGS. 1 and 6 are examples of a preferred sub-class of the class defined above, namely those which comprise (a) at least two round electrodes which are connectable to a source of electrical power;

(b) at least one PTC element which is composed of a PTC composition having a useful $T_s$ of 0° to 280° C., which surrounds and physically contacts substantially the whole of the surface of one of said electrodes, and which makes contact with another of said electrodes over a limited contact area;

(c) a relatively constant voltage (RCW) element which surrounds said electrodes and PTC elements and which makes physical contact with the or each said PTC element and with at least one of said electrodes; and (d) current-directing (CD) elements composed of a relatively insulating (RI) composition and adjacent said limited contact area.

In these devices, preferably at least 30% of the surface area of the (or each) said PTC element is contacted by said RCW element, preferably at least 50% when the device contains only two electrodes. It is also preferred that the ratio of the area of the (or each) said PTC element contacted by said CD element to the area contacted by said CW elements is 0.051:1 to 1.5:1, especially 0.1:1 to 1.2:1, particularly 0.2:1 to 1:1. In order that these devices can be operated with maximum efficiency as heaters it is desirable that the ratio of the external surface area of the CW element to the volume occupied by and enclosed by the CW element should be high, preferably at least 4:1, especially at least 20:1, e.g. about 50:1, but generally not more than about 80:1.

The device illustrated in FIG. 2, is an example of a preferred sub-class of the class defined above, namely those which comprise at least one CD element having a $T_s$ which is below, preferably at least 25° C. below, the useful $T_s$ of any PTC composition, and which device comprises a first electrode, a PTC element which surrounds said first electrode and the whole of whose external surface is in contact with said RCW element and said CD element, and a second electrode the whole of whose surface is in contact with said RCW element and said CD element.

The device illustrated in FIG. 3 is an example of a second class of devices according to the invention, namely those which comprise (1) a first generally planar RCW layer having a first electrode in contact with a portion thereof;

(2) a first generally planar CD layer composed of a PTC composition and having a first face and a second face;

(3) a generally planar PTC layer having a first face and a second face;

(4) a generally planar second CD layer composed of a PTC composition and having a first face and a second face; and (5) a second generally planar RCW layer having a second electrode in contact with a portion thereof;

one face of said first RCW layer being partly in contact with the first face of said first CD layer and partly in contact with a part of the first face of said PTC layer; the second face of said first CD layer being in contact with another part of the first face of said PTC layer; the second face of said PTC layer being partly in contact with a part of one face of said second RCW layer and partly in contact with the first face of said second CD layer; and the second face of said second CD layer being in contact with another part of the face of the second RCW layer.

The devices illustrated in FIGS. 5 and 7 are examples of a third class of devices according to the invention, namely those which comprise (a) a first planar electrode;

(b) a PTC element which surrounds and physically contacts said first planar electrode;

(c) a second planar electrode which physically contacts said PTC element whereby the portion of said PTC element which is sandwiched between the electrodes is a CD element; and (d) a CW element which contacts said second planar electrode and said PTC element.

In each of the devices constructed, according to the invention, the RCW element advantageously has a resistivity that does not increase by more than a factor of 6 in any 30° C. segment below the $T_s$ of the PTC element.

For a heater constructed according to FIG. 8, the PTC layer advantageously has a room temperature resistivity of 3 to 150 ohm. cm, preferably 4 to 15 ohm. cm, while the CW layer advantageously has a room temperature resistivity of from 2 to 20, preferably 6 to 15, ohm. cm. The PTC layer is advantageously composed of about 45% medium density polyethylene, about 10% ethylene/propylene diene rubber, about 44% furnace black and about 1% antioxidant, the percentages being by weight, with a resistivity of from 6 to 10 ohm. cm. at room temperature, with a $T_s$ at about 112° C. The CW layer is advantageously a blend of about 82% ethylene/ethyl acrylate copolymer, with 18% ethyl acrylate, about 17% carbon black and about 1% antioxidant, with a resistivity of about 11 ohm. cm. at room temperature. The I-shaped insulating barrier and the jacket are advantageously high density polyethylene. The device is advantageously crosslinked by irradiation, e.g., to a dose of 10 megarads.

What we claim is:

1. An elongate electrical device which has a substantially constant cross-section along its length and which comprises (a) a first electrode which is connectable to a source of electrical power;

(b) a second electrode which is connectable to a source of electrical power;

(c) a first PTC element which is composed of a PTC composition having a useful $T_s$ of 0° to 280° C. and which surrounds and physically contacts substantially the whole of the surface of said first electrode;

(d) a second PTC element which is composed of a PTC composition having a useful $T_s$ of 0° to 280° C. and which surrounds and physically contacts substantially the whole of the surface of said second electrode;

(e) at least one relatively constant wattage (RCW) element which surrounds said said first and second electrodes and said first and second PTC elements and which makes physical contact with each of said first and second PTC elements; and (f) at least one current-directing (CD) element between said first and second electrodes and between said first and second PTC elements;

wherein when said first and second electrodes are connected to a source of electrical power while the whole device is below its operating temperature, current passes between the electrodes and either immediately or after an initial period of not more than 5 seconds the path of maximum current density passes through each of said first and second PTC elements and at least one RCW element, with the resistance of that current path being greater than the resistance of the current path which would be adopted if the CD element between said first and second electrodes and between said first and second PTC elements were replaced by an element of the same composition as that RCW element.

2. An electrical device according to claim 1 which comprises at least one CD element which is composed of a PTC composition having a useful $T_s$ which is at least 25° C. below the use $T_s$ of said first PTC element and at least 25° C. below the useful $T_s$ of said second PTC element.

3. An electrical device according to claim 1 which comprises at least one CD element which is composed of an electrically insulating composition.

4. An electrical device according to claim 3 wherein each of said first and second PTC elements is composed of a PTC composition having at room temperature resistivity of 3 to 105 ohm. cm and said RCW element is composed of a composition having a room temperature resistivity of 2 to 20 ohm. cm.

* * * * *